US009259108B2

(12) United States Patent
Snep

(10) Patent No.: US 9,259,108 B2
(45) Date of Patent: Feb. 16, 2016

(54) SYSTEM AND METHOD FOR A GROUND COVERING

(71) Applicant: Ryan Michael Snep, Newport Beach, CA (US)

(72) Inventor: Ryan Michael Snep, Newport Beach, CA (US)

( * ) Notice: Subject to any disclaimer, the term of this patent is extended or adjusted under 35 U.S.C. 154(b) by 0 days.

(21) Appl. No.: 13/682,626

(22) Filed: Nov. 20, 2012

(65) Prior Publication Data

US 2013/0074259 A1 Mar. 28, 2013

Related U.S. Application Data

(60) Provisional application No. 61/567,121, filed on Dec. 6, 2011.

(51) Int. Cl.

| | |
|---|---|
| ***A47G 9/06*** | (2006.01) |
| ***A47C 21/08*** | (2006.01) |
| ***A47G 9/00*** | (2006.01) |

(52) U.S. Cl.

CPC ..... *A47G 9/062* (2013.01)

(58) Field of Classification Search

CPC ..... A47G 9/06; A47G 9/00; A47G 9/02; A47C 21/08

USPC ..... 5/417, 419, 420, 732, 739, 740, 657.5, 5/655

See application file for complete search history.

(56) References Cited

U.S. PATENT DOCUMENTS

| | | | | |
|---|---|---|---|---|
| 1,624,797 | A * | 4/1927 | Morehouse | 5/417 |
| 4,634,618 | A * | 1/1987 | Greer et al. | 428/81 |
| 4,709,430 | A | 12/1987 | Nicoll | |
| 4,861,300 | A * | 8/1989 | Casagrande et al. | 441/81 |
| 4,979,531 | A * | 12/1990 | Toor et al. | 135/127 |
| 4,999,866 | A * | 3/1991 | Lindsey | 5/417 |
| 5,206,964 | A * | 5/1993 | Wilson, Sr. | 5/417 |
| 5,349,997 | A * | 9/1994 | Rial | 141/331 |
| 5,351,348 | A * | 10/1994 | Beger | 5/420 |
| 5,371,909 | A * | 12/1994 | McCarty | 5/655 |
| 5,435,024 | A | 7/1995 | Capshaw | |
| 5,455,973 | A * | 10/1995 | Brumfield et al. | 5/424 |
| 5,813,066 | A * | 9/1998 | Gebhard et al. | 5/655 |
| 5,948,250 | A * | 9/1999 | Middleton | 210/232 |
| 6,062,648 | A * | 5/2000 | Adler | 297/440.24 |
| 6,192,536 | B1 | 2/2001 | Connors | |
| 6,199,230 | B1 * | 3/2001 | Parikh | 5/420 |
| 6,274,520 | B1 * | 8/2001 | Cordell | 442/381 |
| 6,393,639 | B1 * | 5/2002 | Ohsner | 5/425 |
| 6,463,605 | B2 | 10/2002 | Swagger, Jr. | |
| 6,474,021 | B2 * | 11/2002 | Homeyer | 49/57 |
| 6,866,269 | B2 * | 3/2005 | Liebau et al. | 273/441 |
| 7,107,635 | B2 * | 9/2006 | Henry et al. | 5/424 |
| 7,607,182 | B1 | 10/2009 | Weiner | |
| 7,661,160 | B1 | 2/2010 | Adams | |
| 8,393,675 | B2 * | 3/2013 | Swanson | 297/226 |

* cited by examiner

*Primary Examiner* — David E Sosnowski
*Assistant Examiner* — Ifeolu Adeboyejo
(74) *Attorney, Agent, or Firm* — Lisa Foundation Patent Law Clinic

(57) ABSTRACT

A ground covering comprised of a flexible material having at least one sleeve attached to the perimeter. A removable frame is placed within the sleeve and is comprised of a pole and a foam material covering at least a portion of the pole.

14 Claims, 8 Drawing Sheets

SYSTEM AND METHOD FOR A GROUND COVERING

CROSS REFERENCE TO RELATED APPLICATION

This application claims the benefit of the provisional application filed by inventor Ryan Michael Snep on Dec. 6, 2011. The application number of the provisional application is 61,567,121, the contents of which have been incorporated by reference. This utility application claims the benefit of the provisional application under 35 U.S.C. 119(e).

BACKGROUND OF THE INVENTION

1. Field of the Invention

The present invention generally concerns ground coverings, and more particularly, representative and exemplary embodiments of the present invention relate to systems, devices and methods relating beach coverings, camping coverings, grass coverings, dirt coverings, rock coverings, sand coverings, and picnic coverings.

2. Description of Related Art

Ground coverings are typically used by people who want to sit, lie down, or otherwise relax on the ground in an outdoor setting. The ground coverings are useful to allow the user to avoid coming into direct contact with the ground, whether the ground is composed of grass, dirt, sand, rocks, organic material, or some other ground material. Typical activities where one might use a ground covering include: camping, picnics, going to the beach, outdoor concerts and plays, stargazing, viewing sporting events, parades, and any other outdoor activity where a person may end up sitting or laying on the ground.

One example of a very common ground covering is the beach towel or beach blanket. Unfortunately, most beach towel users discover that beach towels used as a ground covering rarely stay in one place. Over the duration of user's visit to the beach, the beach towel tends to reposition, bunch up and gather as people move around on top of it or as wind or other elements act upon it. This experience can be very frustrating. Furthermore, sand or other unwanted materials commonly encroach onto the beach towel during its use as a ground covering. This defeats the purpose of using the beach towel as a ground covering altogether; beach towels are not ideal outdoor ground coverings.

Others have attempted to solve some of the aforementioned problems. The following U.S. patents illustrate some examples U.S. Pat. No. 7,661,160 describes a beach blanket having a single pair of sleeves. The sleeves are located on opposing sides of the beach blanket and PVC piping is inserted into the sleeves for the purpose weighting the blanket down. The PVC piping also creates a minimally rigid structure that would keep the blanket from bunching in at least one direction.

U.S. Pat. No. 7,607,182 describes a beach blanket having special tabs with grommets at its corners. The tabs and grommets are attachable to an exterior frame which appears to be piping similar to the piping in U.S. Pat. No. 7,661,160. The external frame has vertical members which allow for the creation of a perimeter wall when the specially tabbed beach blanket is attached to the external frame.

U.S. Pat. No. 6,463,605 describes a beach blanket having special snaps or hooks, which are connectable to an external frame. The external frame described in U.S. Pat. No. 6,463,605 is made up of a type of inflatable material that is coated in vinyl. The frame can be deflated and inflated through a special air valve attached to the frame.

U.S. Pat. No. 6,192,536 describes a beach blanket having a set of pockets around its periphery. The pockets are intended to be filled with sand or other material. The weighted pockets will then hold the blanket in place.

U.S. Pat. No. 5,435,024 describes a ground covering which can be wrapped around an external frame. The frame is made up of piping which, when assembled, forms a circular frame. A ground cover, having a band around its perimeter, can be wrapped around the assembled frame.

U.S. Pat. No. 5,206,964 describes a beach blanket having notched corners. The periphery of the beach blanket is wrapped around an inflatable tube having an air valve for inflation and deflation.

U.S. Pat. No. 4,709,430 describes a beach blanket very similar to the beach blanket described in U.S. Pat. No. 5,206,964 except the tube is designed to be filled with a liquid instead of inflated with air.

Some of the above mentioned devices have too many easy-to-lose parts and are complex to assemble. Others would be difficult to transport. Some require time and effort to inflate or fill with air, water or sand, and could be very heavy when filled with those materials. Devices inflated with air, water, or sand also could puncture and lose the materials within their perimeters, creating a larger mess than they were designed to avoid. Others require anchoring. Some attempt to solve the problem of beach blanket bunching, but do not resolve the issue of sand encroachment. Some would be difficult to clean or launder. Still others may be too heavy to move, once inflated, necessitating a repeated setting up and breaking down of the device if the user requires rapid mobility.

In view of the above related art, there remains a need for a ground covering which is simple, easy-to-assemble, easy-to-transport, easy-to-clean, and provides a solution to at least the problems of beach blanket bunching and the encroachment of unwanted materials onto ground coverings.

BRIEF SUMMARY OF THE INVENTION

The present invention provides among other things, a ground covering. The ground covering is comprised of a flexible material having a perimeter edge defining the shape of the flexible material. The shape of the flexible material could be one any closed shapes. For example, the shape could be a rectangle, an ellipse, a regular polygon or an irregular polygon. The flexible material may be comprised of both water absorbent and water impermeable materials. For example, the flexible material could be made of cotton, polyester, tarpaulin, a plastic material, or some combination thereof. As another example, the flexible material could be made out of a beach blanket. The ground covering also is comprised of a sleeve or multiple sleeves attached to, or integral with, the perimeter sides of the flexible material. The sleeves may be made of the same material as the flexible material or with a different material. The sleeves have two ends and at least one opening located along the sleeve. The ends may be closed, open, or may be configured to be closable. The openings may occur at any point along the sleeve. A removable frame is found within each of the sleeves. The removable frame is comprised of a pole encased within an elongated piece of foam material. The poles may be made of various different materials. For example, the poles could be made of a fiberglass material, a metal material, an aluminum alloy material, or a plastic material. The poles may also be solid or hollow. The foam material may also be made of various different materials. For example, the foam material may be a polyethylene foam, a polyurethane foam, foam rubber, a closed-cell foam or an open-cell foam. In one embodiment, the foam material is also coated in a protective material. For example, the foam material could be coated in latex or vinyl.

In some embodiments, the removable frame is comprised of multiple segments. Each frame segment may additionally be configured to be coupled with, and subsequently separable from, adjacent frame segments. In one embodiment, the foam of the frame segments is configured to be coupled with the foam of adjacent frame segments. In one embodiment, the poles of the frame segments are configured to be coupled with the poles of adjacent frame segments. In one embodiment the coupling is accomplish with a connecting sleeve that is secured to one end of a pole that is configured to receive an end of an adjacent pole. The connecting sleeve may be attached to or integral with the pole. In one embodiment, an elastic cord is laced through the poles. The elastic cord provides a tension which keeps the poles, and thus adjacent frame segments, interconnected.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographer, to use only the plain and ordinary meaning of terms in the specification and claims unless he clearly states otherwise and then further, expressly sets forth the "special" definition of that term and explains how it differs from the plain and ordinary meaning Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. §112, ¶ 6. Thus, the use of the words "function," "means" or "step" in the Detailed Description or Description of the Drawings or claims is not intended to somehow indicate a desire to invoke the special provisions of 35 U.S.C. §112, ¶ 6, to define the invention. To the contrary, if the provisions of 35 U.S.C. §112, ¶ 6 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventor not to invoke the provisions of 35 U.S.C. §112, ¶ 6. Moreover, even if the provisions of 35 U.S.C. §112, ¶ 6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention. It should be noted that there are many different and alternative configurations, devices and technologies to which the disclosed inventions may be applied. The full scope of the inventions is not limited to the examples that are described below.

Figure 1:
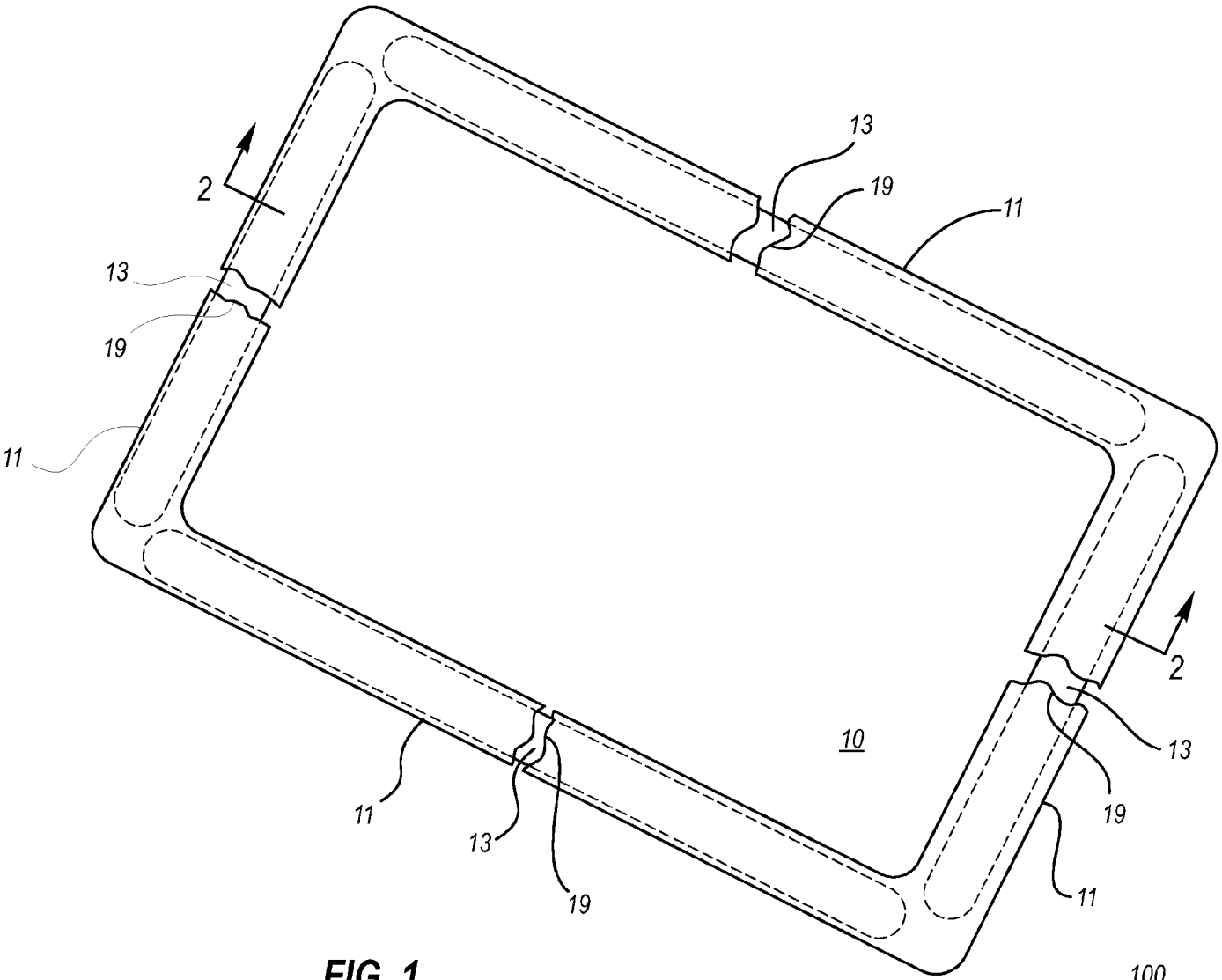
FIG. 1 depicts a top view of the ground covering according to an embodiment of the invention.

FIG. 1 shows a top view of the ground covering 100 in accordance with an embodiment. Ground covering 100 includes a section of flexible material 10. Flexible material 10 is depicted in FIG. 1 as having a perimeter substantially rectangular in shape. In alternative embodiments, flexible material 10 may have a perimeter comprising any closed shape, for example, the perimeter of flexible material 10 may be triangular, square, hexagonal, regular or irregular polygonal, circular, or elliptical. Flexible material 10 may be comprised of a variety of different materials. For example, flexible material 10 may be comprised of cotton, polyester, tarpaulin, a plastic material, or some combination thereof. Flexible material 10 may comprise a material which is water absorbent or may comprise a material which is water impermeable. In the embodiment shown, flexible material 10 comprises a cotton material which is water absorbent.

Sleeves 11 are shown coupled to the perimeter of flexible material 10. In FIG. 1, four sleeves 11 are shown, one attached to each of the four sides of the perimeter of flexible material 10. In alternative embodiments, ground covering 100 may comprise more sleeves or less sleeves. It is not a limitation of the present invention that all sides of the flexible material have a sleeve attached to them, nor is it a limitation that the sleeves extend along the entire length of any given side to the perimeter of ground covering 100. Sleeves 11 may be integral with flexible material 10 or may be attached to flexible material 10 through various attachment mechanisms. For example, sleeves 11 may be attached to flexible material by sewing, adhesive, Fabric fastening tape, buttons and holes, snaps, hooks, pins, zippers or any other method of attaching two materials together. Sleeves 11 may be comprised of the same material as flexible material 10 or may be comprised of a material different than flexible material 10. In the embodiment shown, sleeves 11 comprise the same material as flexible material 10 and are integral with flexible material 10. Each of sleeves 11 are shown as having two ends and an opening 19 occurring at a midpoint along the length of the sleeves 11. Openings 19 allow removable frames 13 to be inserted and removed from sleeves 11. Openings 19 may comprise a hole or separation in the material of sleeves 11. The openings 19 may be of any shape and may run along the length of sleeves 11 or across the width of sleeves 11. In an alternative embodiment, openings 19 may further comprise a closing mechanism, not shown, for closing openings 19. The closing mechanism may comprise a zipper, Fabric fastening tape, buttons and holes, snaps, or any other suitable mechanism for closing openings 19. The number of openings 19 and the placement of openings 19 along sleeves 11 may also be chosen so as to coincide with separable points of the removable frames 13. If, for example, removable frames 13 are separable at their midpoints, placement of openings 19 at the midpoint of sleeves 11 would allow one to collapse and fold ground covering 100 without removing removable frames 13. This configuration would allow for quick and easy set-up and take-down of ground covering 100, and would also allow ground covering 100 to be transportable by a single person. In an alternative embodiment, openings 19 may occur at other locations along sleeves 11, for example, openings 19 may occur at one or both of the ends of sleeves 11. This embodiment is particularly useful for inserting removable frames 13 which are not flexible, separable, or bendable. In this alternative embodiment, the openings 19 occurring at one or both of the ends of sleeves 11 could also comprise a closing mechanism as described above for enclosing the removable frames 13 within sleeves 11. The quantity and location of openings 19 is not a limitation of the present invention.

Removable frames 13 are intended to be inserted into sleeves 11. Removable frames 13 are shown to be cylindrical in shape, but may also comprise any variety of shapes, including for example, rectangular. Furthermore, removable frames 13 are shown with rounded ends, but may also comprise any variety of end shapes, including for example, flat ends. In one embodiment, removable frames 13 may be made of a foam-type material. This material can comprise any sort or type of foam, including for example, polyethylene foam, polyurethane foam, foam rubber, closed-cell foams and open-cell foams. The foam of removable frames 13 may also comprise a coating on it which protects the foam when removed from sleeves 11 and also permits the removable frames 13 to be inserted or removed from sleeves 11 with ease. The coating may comprise, for example, a vinyl or latex coating. In this embodiment, removable frames 13 comprise a closed-cell foam material coated in vinyl. Further structural description of removable frames 13 is provided in FIG. 2.

Figure 2:
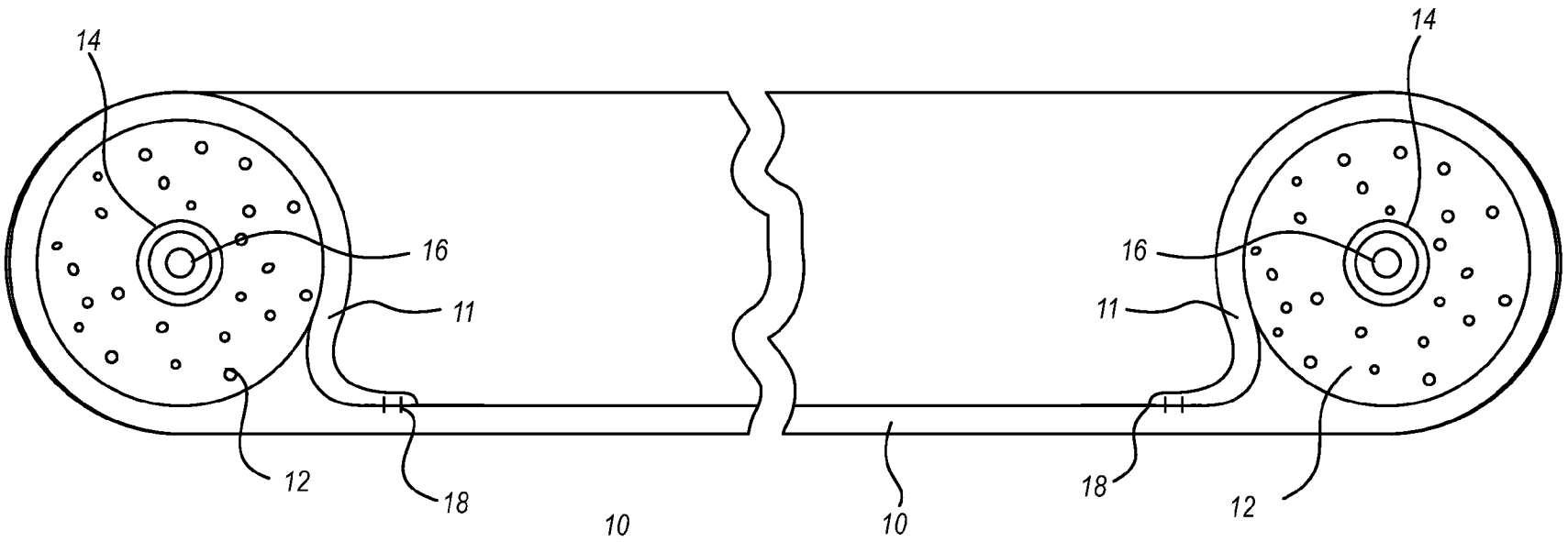
FIG. 2 depicts a cross-sectional view of the ground covering according to an embodiment of the invention.

FIG. 2 shows a cross-sectional view of the ground covering along the line 2 in FIG. 1. In particular, FIG. 2 depicts a cross-sectional view of removable frames 13. In addition to foam material 12, removable frames 13 may also comprise poles 14 within the foam material 12. The poles provide structural support for foam material 12 and removable frames 13, and thus also provide structural support for ground cover 100. Poles 14 may be either solid poles or hollow poles. Poles 14 may be comprised of a variety of different materials, for example, poles 14 may be made of fiberglass, aluminum alloys, wood, metal, plastic, or some combination thereof, or any other material that would allow pole 14 to provide structural support to foam material 12. In FIG. 2, poles 14 are comprised of a hollow fiberglass material. In an alternative embodiment, poles 14 may contain an elastic cord 16. Elastic cord 16 may run between two adjacent poles and may be useful maintaining two adjacent poles in an interconnected position.

In FIG. 2, sleeves 11 are shown being an integral with flexible material 10. Sleeves 11 are shown to wrap around the removable frames and attach to either itself or flexible material 10 at attachment point 18. In an alternative embodiment, shown for example in FIG. 4, sleeves 11 are not integral with flexible material 10 and attachment point 18 represents the point at which sleeves 11 are attached to flexible material 10. In any embodiment, attachment point 18 may represent attachment by either sewing, adhesive, fabric fastening tape, buttons and holes, snaps, hooks, pins, zippers or any other method of attaching materials together.

Figure 3:
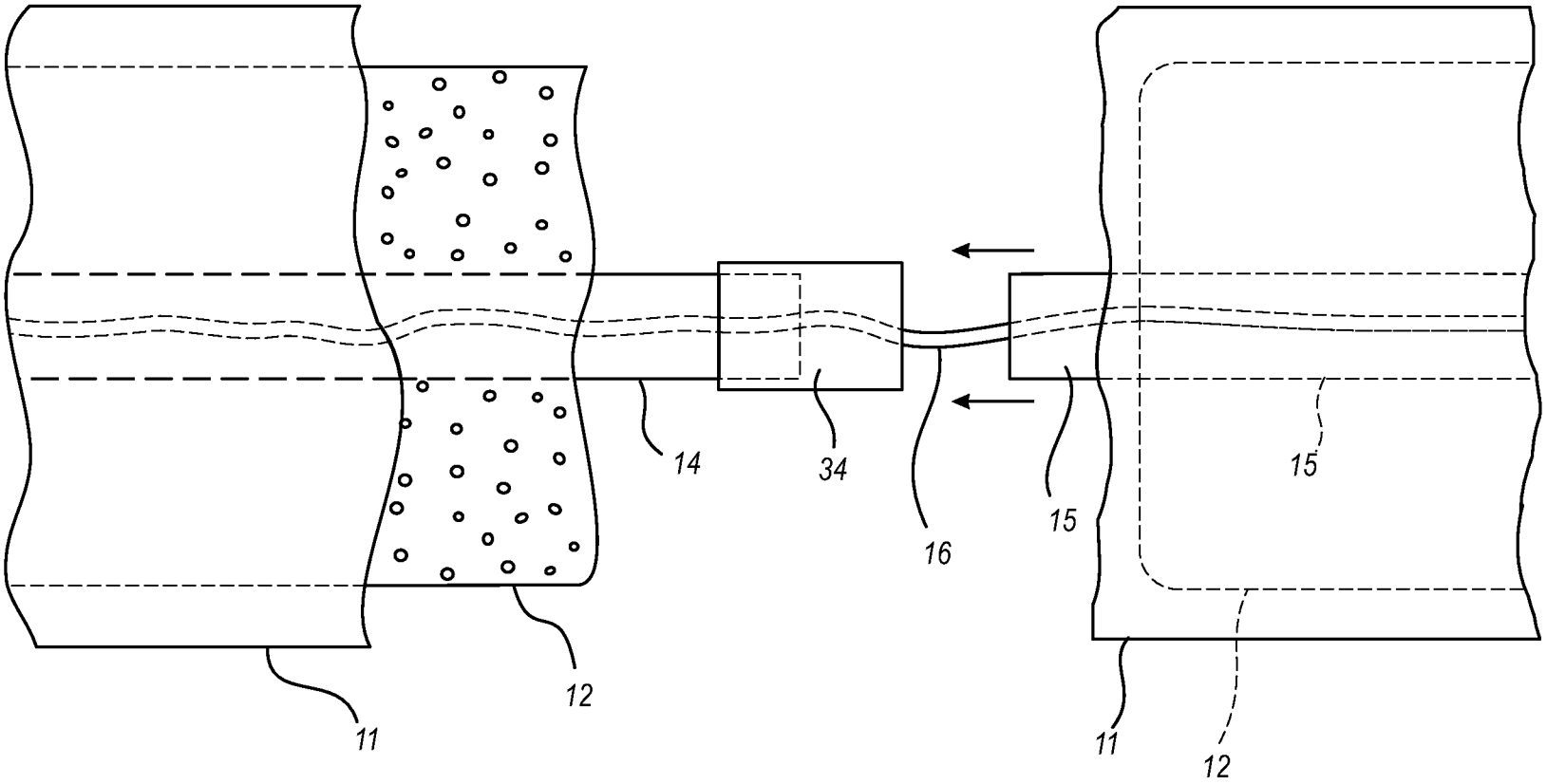
FIG. 3 depicts a cut-away front view of a portion of the ground covering according to an embodiment of the invention.

FIG. 3 shows cut-away front view of a portion of the sleeves 11 and removable frame 13 of ground covering 100. FIG. 3 shows sleeves 11, foam material 12, poles 14 and 15, elastic cord 16 and a connecting sleeve 34. As shown, connecting sleeve 34 is coupled to one end of pole 14 and is configured to allow an end of an adjacent pole 15 to be inserted within. The use of a connecting sleeve 34 allows adjacent poles to be coupled and remain in a coupled position under normal circumstances of use of ground covering 100. It is not, however a limitation of the present invention that poles 14 or 15 have a connecting sleeve 34 or the ability to couple with adjacent poles, nor is it a limitation that adjacent segments, if any, of removable frames 13 have the ability to couple.

Coupling of segments of removable frames 13 can be accomplished in many alternative ways, including for example, configuring an end of foam material 12 to allow an end of an adjacent segment of foam material 12 to be inserted and coupled thereto. In alternative embodiment, Fabric fastening tape may be attached to an end of a segment of foam material 12 and additionally to an end of an adjacent segment of foam material to allow the coupling of segments of removable frames 13 together. In an alternative embodiment, buttons or snaps may be used to couple adjacent removable frame segments together.

In the embodiment shown in FIG. 3, an adjacent pole 15 is inserted and interconnected with pole 14, and elastic cord 16 will provide a tension that will generally keep the poles in an interconnected position until the user wants the segments of removable frame 13 to be separated and folded or separated and removed from sleeves 11. The location of this interconnection may be designed so as to coincide with openings along sleeve 11 as demonstrated in FIGS. 5 and 6. The use of elastic cord 16 is considered to be an additional embodiment of the invention and is not a limitation of the present invention. In alternative embodiments, alternative methods of coupling pole 14 with adjacent pole 15 may be used. For example, the end of pole 14 may simply be hollow and large enough for the end of adjacent pole 15 to be inserted within.

In one embodiment, foam 12 extends to the outer edge of connecting sleeve 34 so as be flush with connecting sleeve 34. In this embodiment, however, the foam 12 surrounding pole 15 would not extend to the end of pole 15. Instead, it would leave a portion of pole 15 protruding from foam material 12.

In one embodiment poles 14 and 15 may be attached to foam material 12 with an adhesive. The adhesive may be useful to keep the foam material 12 from sliding up and down poles 14 and 15. In another embodiment, an end of poles 14 and 15 is completely encased within foam material 12 so that foam 12 does not slide up and down poles 14 and 15. In an alternative embodiment, poles 14 and 15 may fit snugly and tightly within foam material 12 so that foam material 12 does not slide up and down poles 14 and 15.

Figure 4:
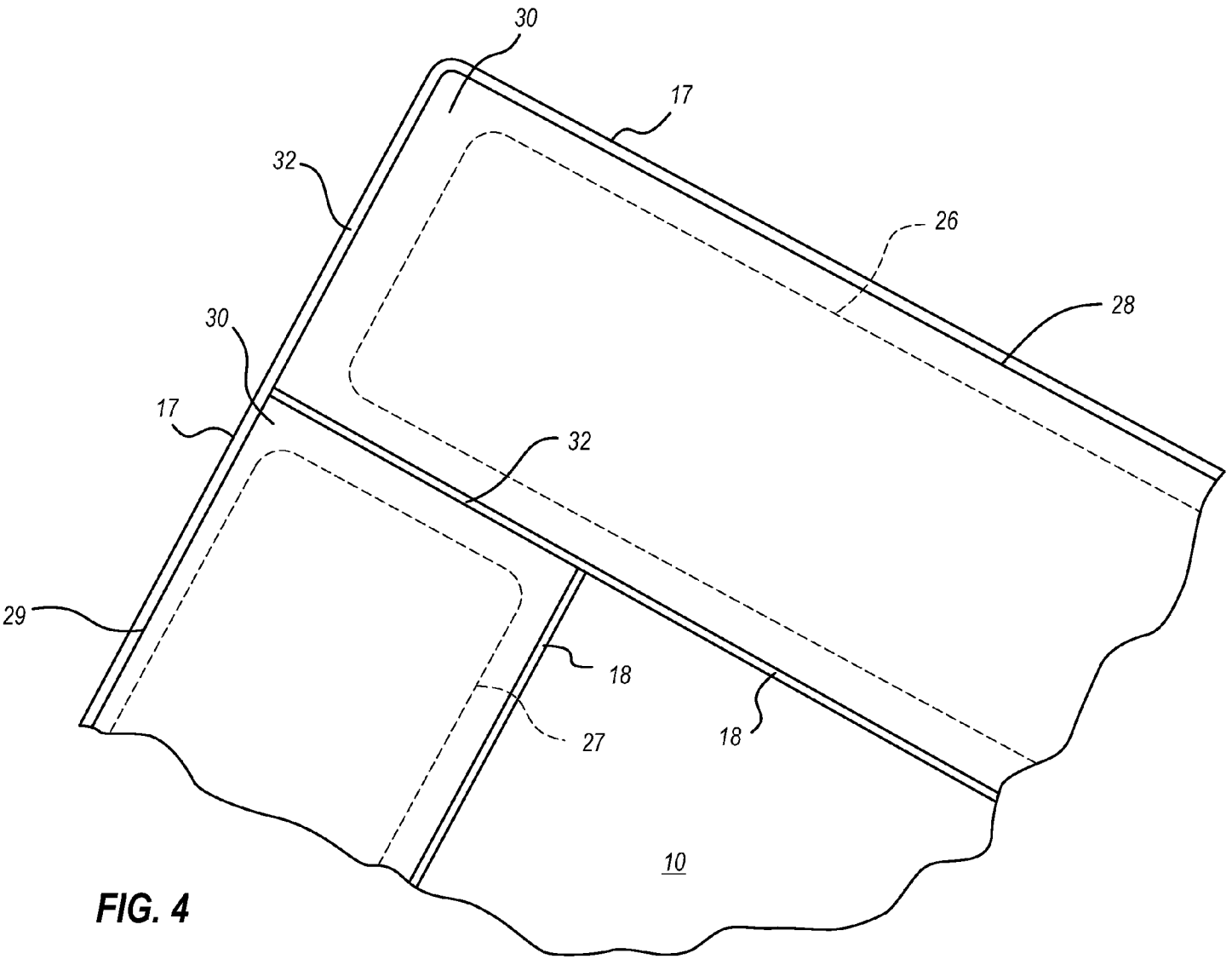
FIG. 4 depicts a top view of a corner portion of the ground cover according to an embodiment of the invention.

FIG. 4 shows a top view of a corner portion of the ground cover according to an embodiment. In this embodiment, an end of sleeve 28 extends past the perimeter of flexible material 10 and connects with sleeve 29 such that the end of sleeve 28 and the side of sleeve 29 form a substantially straight line. In this embodiment, removable frame 26 has a flat end and also extends past the perimeter of flexible material 10. In this embodiment, removable frame 26 and sleeve 28 act as a barrier to sleeve 19 and removable frame 27. When fully assembled and deployed, this configuration provides a tight fit for the removable frame 29, which in turn adds to the rigidity of ground covering 100. Furthermore, FIG. 4 shows an alternative embodiment where in sleeves 28 and 29, which may correspond to sleeves 11 in previous figures, are comprised of a top sleeve piece 30 and a bottom sleeve piece (not shown). The top sleeve pieces 30 and the bottom sleeve pieces are attached together at their attachment perimeters 17, 18 and 32. The attachment perimeters 17, 18, and 32 of the top and bottom sleeve pieces may be attached together, for example, by sewing, adhesive, Fabric fastening tape, buttons and holes, snaps, hooks, pins, zipper or any other method of attaching two materials together. Furthermore, attachment perimeter 18 may represent the perimeter at which sleeves 28 and 29, which may correspond to sleeves 11 in previous figures, are attached to flexible material 10. Attachment of sleeves 28 and 29 to flexible material 10 may be accomplished, for example, by sewing, adhesive, Fabric fastening tape, buttons and holes, snaps, hooks, pins, zipper or any other method of attaching two materials together.

Figure 5:
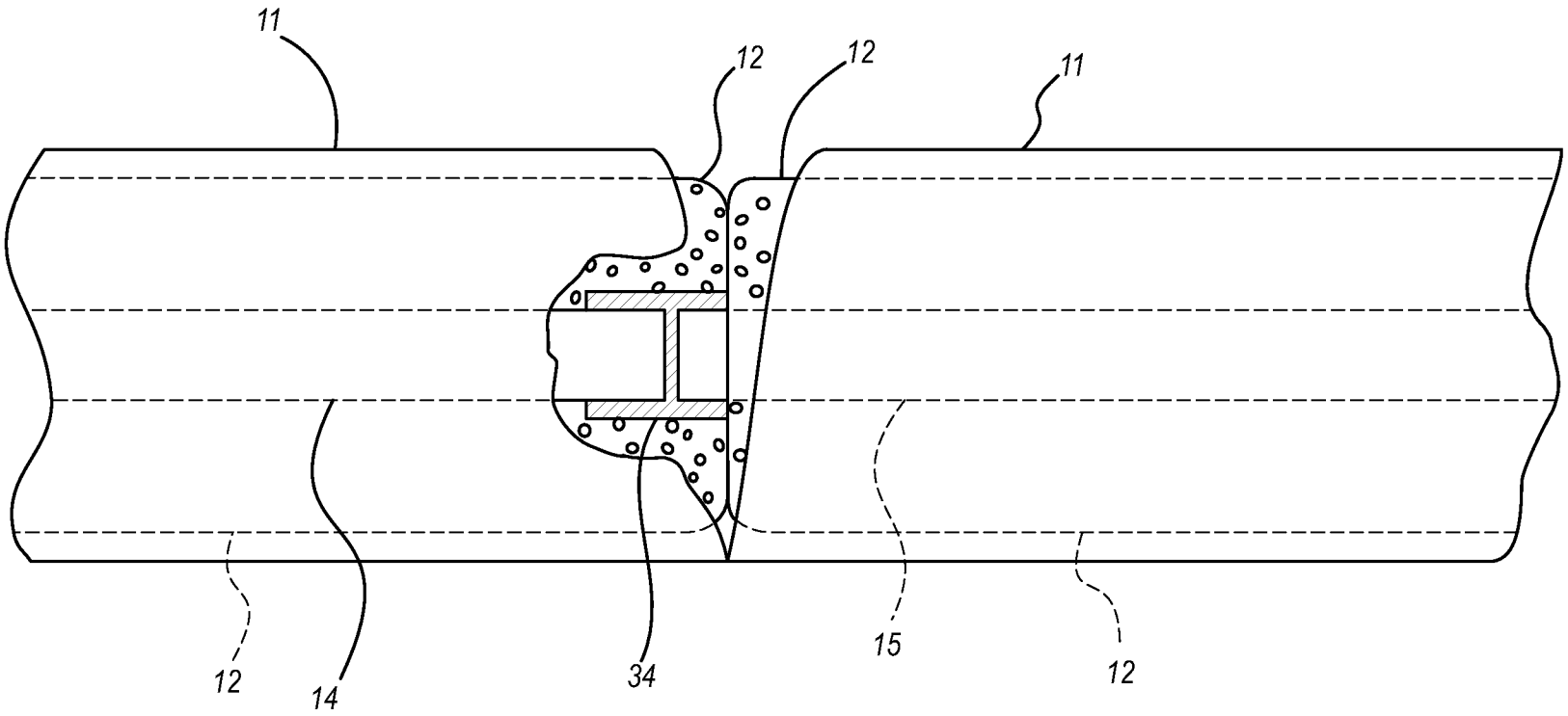
FIG. 5 depicts a front view of a portion of a sleeve of the ground covering according to an embodiment of the invention.

FIG. 5 shows a front view of a portion of sleeve 11 of ground covering 100 according to an embodiment. FIG. 5 shows two segments of a removable frame in the interconnected position. This position, when repeated across on all removable frame segments within ground covering 100 represents a complete, usable assembly of ground covering 100. To disassemble, poles 14 and 15 can be pulled apart by accessing the removable frame segments through the opening. This disassembly may be repeated for each interconnected pole. Once the removable frame segments have been separated from each other, the ground covering may be folded and transported with the removable frame segments still within the sleeves or each removable frame may be pulled out of the sleeves through the opening and the sleeves and flexible material may be folded up. With the removable frame segments folded and the remaining ground covering materials folded, the disassembled device can be easily transported by hand or may be packed into a carrying sack (not shown).

In an alternative embodiment, there is only one removable frame segment per sleeve. In this embodiment, the removable frame segments are inserted and removed through an opening located at the end of the sleeve. When the removable frame segment is inserted within the sleeve, the end of the sleeve may be closeable with Fabric fastening tape, buttons and holes, snaps, hooks, pins, zippers or any other method of closing two materials together.

In another alternative embodiment there are three or more segments of removable frame per sleeve. In this embodiment there may also be multiple openings along each sleeve.

Figure 6:
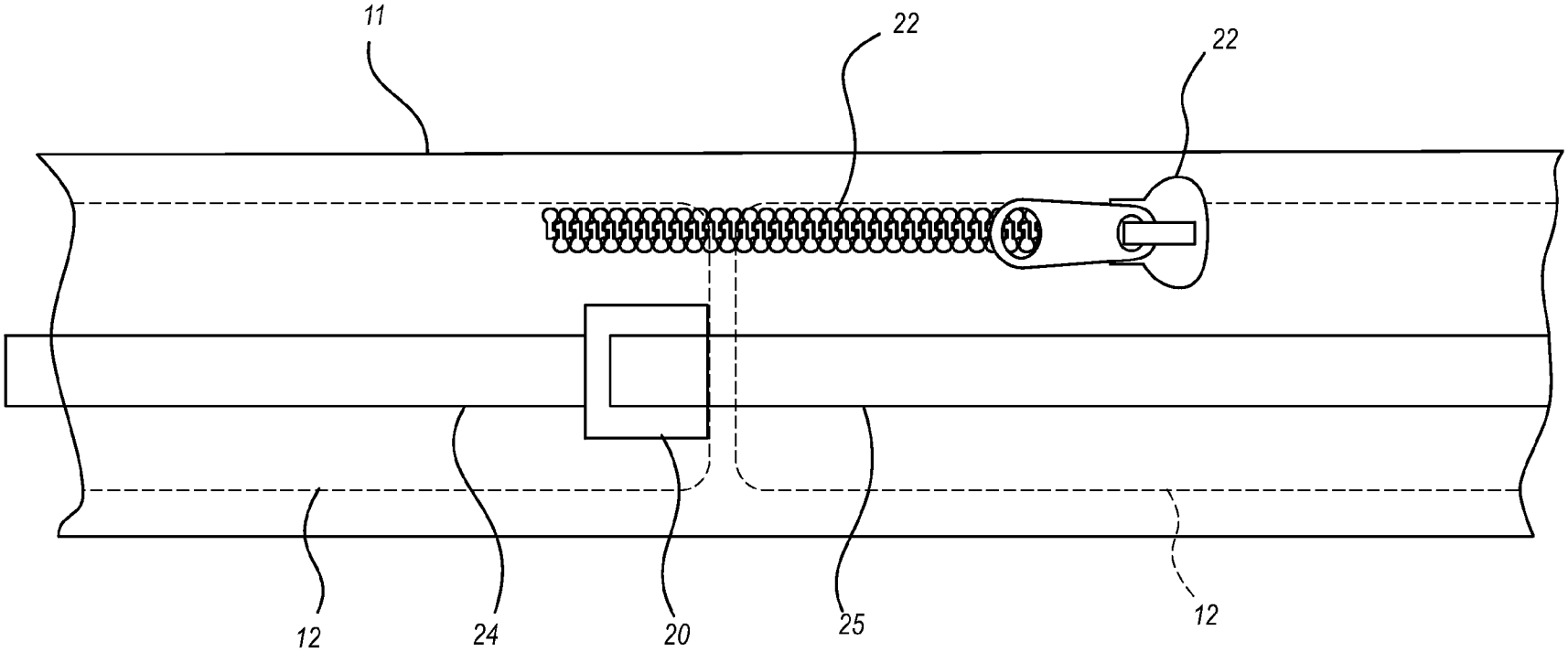
FIG. 6 depicts a front view of a portion of the ground covering according to an embodiment of the invention.

FIG. 6 shows a front view of a portion of sleeve 11 of ground covering 100 according to another embodiment. In this embodiment, an opening is created with a zipper 22 which runs along a portion of the length of sleeve 11. Alternatively, zipper 22 could run along a portion of the width of sleeve 11. FIG. 6 also shows poles 24 and 25 in an alternative connecting configuration, wherein connecting sleeve 20 is integral with pole 14, and wherein the connecting sleeve 20 has an opening large enough to receive the end of pole 15. Alternatively, the opening in connecting sleeve 20 of pole 14 could be made smaller so long as the end of pole 15 was also made smaller such that it could still be inserted into an end of pole 14.

In an alternative embodiment, zipper 22 could be replaced with an opening lined with Fabric fastening tape, buttons and holes, snaps, hooks, pins or any other device effective for closing two materials together.

Figure 7:
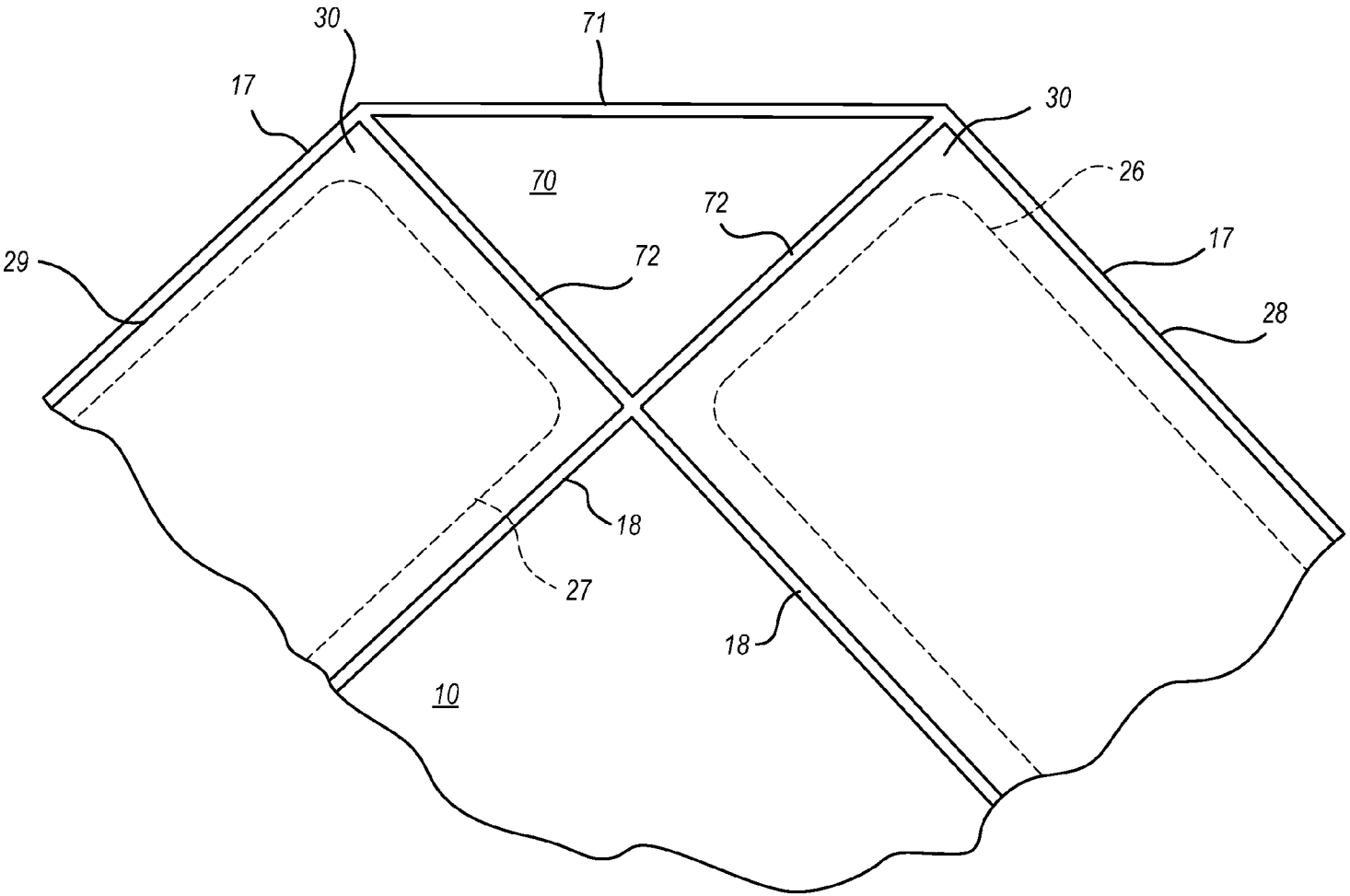
FIG. 7 depicts a top view of a corner portion of the ground cover according to an embodiment of the invention.

FIG. 7 shows a top view of a corner portion of the ground cover according to an embodiment. In this embodiment, sleeve 28 extends along one side of the perimeter of flexible material 10 and sleeve 29 extends along a second side of the perimeter of flexible material 10. Both sleeves 28 and 29 may terminate at an end of a side of the perimeter of flexible material 10. Both sleeves 28 and 29 may be closed off at their ends 72. An optional section of material 70 may be attached to the ends of sleeves 28 and 29. A section of material 70 may comprise the same material as flexible material 10, or may comprise the same material as sleeves 28 and 29. In an alternative embodiment, sleeves 28 and 29 are not closed off at ends 72 and material 70 forms a sleeve extension to both sleeves 28 and 29, thus creating a continuous sleeve between sleeve 28 and 29. In the alternative embodiment, sleeve extension 70 may be closed along its outside perimeter 71 and removable frames 26 and 27 would extend into sleeve extension 70. In the embodiment shown, removable frames 26 and 27 have a flat end and extend almost to the ends of sleeves 28 and 29. In the embodiment, closed ends 72 act as a barrier upon which the ends of removable frames 26 and 27 may push up against. When fully assembled and deployed, this configuration provides a tight fit for the removable frames 26 and 27, which in turn adds to the rigidity of ground covering 100. Furthermore, FIG. 4 shows an alternative embodiment wherein sleeves 28 and 29, which may correspond to sleeves 11 in previous figures, are comprised of a top sleeve piece 30 and a bottom sleeve piece (not shown). The top sleeve pieces 30 and the bottom sleeve pieces are attached together at their attachment perimeters 17, 18, and 72. The attachment perimeters 17, 18, and 72 of the top and bottom sleeve pieces may be attached together, for example, by sewing, adhesive, Fabric fastening tape, buttons and holes, snaps, hooks, clips, pins, zippers, or any other method of attaching two materials together. Furthermore, attachment perimeter 18 may represent the perimeter at which sleeves 28 and 29 (which may correspond to sleeves 11 in the previous figures) are attached to flexible material 10. Attachment of sleeves 28 and 29 to flexible material 10 may be accomplished, for example, by sewing, adhesive, Fabric fastening tape, buttons and holes, snaps, hooks, pins, clips, zippers, or any other method of attaching two materials together. In alternative embodiments, sleeves 28 and 29 are integral with flexible material 10.

Figure 8:
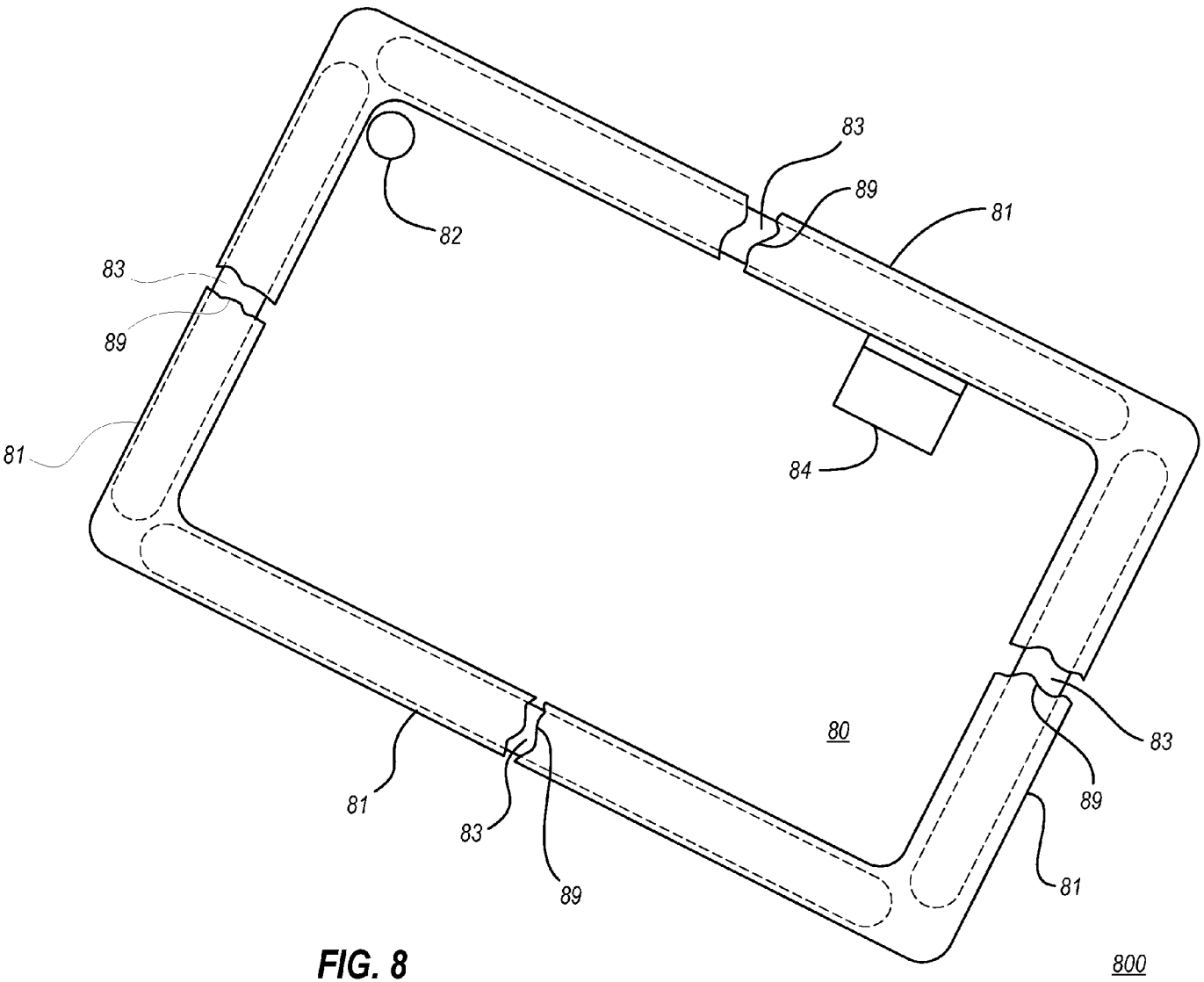
FIG. 8 depicts a top view of the ground covering in accordance with an embodiment.

FIG. 8 shows a top view of the ground covering 800 in accordance with an embodiment. Ground covering 800 includes a section of flexible material 80. Flexible material 80 is depicted in FIG. 8 as having a perimeter substantially rectangular in shape. In alternative embodiments, flexible material 80 may have a perimeter comprising any closed shape. For example, the perimeter of flexible material 80 may be triangular, square, hexagonal, a regular or irregular polygon, circular, or elliptical. Sleeves 81 are shown coupled to the perimeter of flexible material 80. Each of sleeves 81 are shown as having two ends of an opening 89. Openings 89 allow removable frames 83 to be inserted and removed from sleeves 11.

FIG. 8 also shows a cup holder 82 and a pocket 84. Cup holder 82 may be positioned anywhere on ground covering 800, and in this embodiment is positioned on flexible material 80. Cup holder 84 may be comprised of any of the abovementioned materials by which flexible material 80 is comprised. In one embodiment, cup holder 82 is comprised of a mesh material. Cup holder 82 may extend in a downward direction from flexible material 80 and into the ground upon which flexible material 80 lays. In alternative embodiment, the cylindrical portion of cup holder 82 is made of the aforementioned materials by which flexible material 80 is comprised, while the base is comprised of mesh. In another alternative embodiment, ground covering 800 may comprise multiple cup holders located at various positions on ground covering 800. Cup holder 82 is useful for storing cans, cups, bottles, and beverage containers.

Pocket 84 may also be positioned anywhere on ground covering 800. In this embodiment, pocket 84 is positioned near the perimeter of flexible material 80. Pocket 84 may be comprised of any of the abovementioned materials for which flexible material 80 is comprised. In one embodiment, pocket 84 is comprised of a mesh material. Pocket 84 is useful for storing the user's personal items and belongings. These include cell phones, wallets, lotions, cosmetics, keys, sunglasses, and the carrying sack for ground covering 800.

I claim:

1. A ground covering, comprising:

a flexible material having an upper and a lower surface, the flexible material also having a perimeter edge defining the shape of the flexible material; and a plurality of sleeves coupled to at least a portion of the perimeter edge of the flexible material, each sleeve having two closed ends and an opening located between the two closed ends, wherein each sleeve contains a removable frame, the removable frame comprising a pole, the pole having at least a portion of its shaft covered with a foam material, wherein the removable frame in each of the plurality of sleeves is separate from the removable frame in each of the other plurality of sleeves, the removable frame comprising a first segment configured to be inserted through the opening towards a first of the two closed ends and a second segment configured to be inserted through the opening toward a second of the two closed ends, and wherein the first segment of the removable frame is separable from the second segment of the removable frame at a folding point, wherein the opening of the sleeves are located at a midpoint along the length of the sleeve overlapping the folding point, and the removable frame configured to fold at the opening when positioned in the sleeve to enable folding of the flexible material at each opening and removal of the removable frame from each opening when the removable frame and the flexible material are folded.

2. The ground covering of claim 1, wherein the sleeves are integral with at least a portion of the perimeter edge of the flexible material.

3. The ground covering of claim 1, wherein the first segment of the removable frame is configured to be coupled to the second segment of the removable frame.

4. The ground covering of claim 1, wherein the pole of the first segment of the removable frame is configured to be coupled with the pole of the second segment of the removable frame.

5. The ground covering of claim 4 wherein at the pole of the first segment of the removable frame further comprises a connecting sleeve secured to one end of the pole of the first segment of the removable frame, the connecting sleeve configured to receive an end of the pole of the second segment of the removable frame.

6. The ground covering of claim 1, further comprising an elastic cord laced through both the pole of the first segment of the removable frame and the pole of the second segment of the removable frame.

7. The ground covering of claim 1, wherein the foam material of the first segment of the removable frame is configured to be coupled with the foam material of the second segment of the removable frame.

8. The ground covering of claim 1 wherein the flexible material comprises one of cotton, polyester, tarpaulin, and plastic.

9. The ground covering of claim 1, wherein the flexible material is one of a water absorbent material or a water impermeable material.

10. The ground covering of claim 1, wherein the flexible material and the sleeves are comprised of the same material.

11. The ground covering of claim 1, wherein the shape of the flexible material is one of an ellipse and a rectangle.

12. The ground covering of claim 1, wherein the pole is comprised of one of a fiberglass material, a metal material, an aluminum alloy material, and a plastic material.

13. The ground covering of claim 1, wherein the pole is one of a hollow pole and a solid pole.

14. The ground cover of claim 1, wherein at least a portion of the foam material is coated in one of latex and vinyl.

* * * * *